US009839247B2

(12) United States Patent
Etheridge et al.

(10) Patent No.: US 9,839,247 B2
(45) Date of Patent: Dec. 12, 2017

(54) PERFORMANCE GARMENT HAVING A REALISTIC VISUAL EFFECT OF ABRADED DENIM

(71) Applicant: lucy apparel, llc, Wilmington, DE (US)

(72) Inventors: Laurie Etheridge, San Rafael, CA (US); Keryn Francisco, Alameda, CA (US); Maria Puopolo, San Francisco, CA (US); Stacey Keetell, San Mateo, CA (US); Isabelle Delafontaine, Oakland, CA (US); Patricia Stapp, Pleasanton, CA (US)

(73) Assignee: LUCY APPAREL, LLC, Wilmington, DE (US)

( * ) Notice: Subject to any disclaimer, the term of this patent is extended or adjusted under 35 U.S.C. 154(b) by 0 days.

(21) Appl. No.: 15/155,491

(22) Filed: May 16, 2016

(65) Prior Publication Data

US 2017/0325530 A1 Nov. 16, 2017

(51) Int. Cl.

| | |
|---|---|
| ***A41D 1/06*** | (2006.01) |
| ***A41D 31/00*** | (2006.01) |
| ***A41D 1/08*** | (2006.01) |
| ***A41D 27/08*** | (2006.01) |

(52) U.S. Cl.
CPC ..... *A41D 31/00* (2013.01); *A41D 1/08* (2013.01); *A41D 27/08* (2013.01)

(58) Field of Classification Search
CPC ..... A41D 13/02; A41D 1/06; A41D 3/00
See application file for complete search history.

(56) References Cited

U.S. PATENT DOCUMENTS

| | | | | |
|---|---|---|---|---|
| 2008/0141441 | A1* | 6/2008 | Canter | D06P 5/00 2/227 |
| 2013/0095730 | A1* | 4/2013 | Jensen | A41C 1/003 450/95 |
| 2013/0174317 | A1 | 7/2013 | Young | |
| 2014/0020155 | A1* | 1/2014 | Israel | A41D 1/06 2/237 |

(Continued)

FOREIGN PATENT DOCUMENTS

| | | |
|---|---|---|
| CN | 201581196 | 9/2010 |
| WO | 2005105470 | 11/2005 |

OTHER PUBLICATIONS

"New Arrival Europe Women Hole Elasticity Jeans Heat Transfer Print on Jeans", www.alibaba.com/ product-detail, dated Aug. 11, 2015. (9 pages).

(Continued)

*Primary Examiner* — Tejash Patel
(74) *Attorney, Agent, or Firm* — McAndrews, Held & Malloy, Ltd.

(57) ABSTRACT

Embodiments of the present disclosure are directed to a performance garment having a realistic visual effect of being constructed from abraded denim. The performance garment comprises a number of fabric panels that are adjoined together to form the garment. Each fabric panel is made of a stretch performance fabric that contains at least 50% polyester and at least 10% of one or more elastomeric materials. Each fabric panel is printed with a pattern that provides the fabric panel with the visual effect of abraded denim. For instance, each fabric panel may be printed with an original digital pattern that was not produced from imaging a denim garment.

20 Claims, 7 Drawing Sheets

(56) References Cited

U.S. PATENT DOCUMENTS

| | | | | |
|---|---|---|---|---|
| 2014/0068836 | A1* | 3/2014 | Tulin | A41D 1/06 2/227 |
| 2014/0165265 | A1* | 6/2014 | Tulin | A41D 1/06 2/234 |
| 2016/0174642 | A1* | 6/2016 | Rotter | A41D 27/02 450/95 |

OTHER PUBLICATIONS

"Materials Sustainability—Eco Colour", Tamasyn Gambell, www.wgsn.com, dated Oct. 27, 2009. (9 pages).
"The New & Innovative AG Jeans Digital Luxe Denim", htp://thejeansblog.com, dated Aug. 11, 2015. (19 pages).
Internet Archive Waybackmachine, www.adidas.com/us/adidas_stellasport, dated Aug. 16, 2015. (1 page).
Internet Archive Waybackmachine, www.geniebra.com/genie-slim-jeggings, dated Aug. 1, 2016. (1 page).
Internet Archive Waybackmachine, www.inknburn.com, dated Aug. 2013 to Feb. 2015. (5 pages).
Notification of Transmittal of the International Search Report and the Written Opinion of the International Searching Authority, or the Declaration with International Search Report and Written Opinion corresponding to International Application No. PCT/US 17/31760, dated Aug. 11, 2017.
Joe Scout, "What are the Advantages of Dye Sublimation Printing?", Mar. 17, 2014 (Mar. 17, 2014) para[0004], [0006] Retrieved on Jun. 29, 2017 (Jun. 29, 2017) from http://www.cl ubink.ca/blog/dye-sublimation/advantages-dye-sublimation-printing/.
Jimmy Lamb, "Small or Wide Sublimation", Sep. 1, 2011 (Sep. 1, 2011) para [0004] Retrieved on Jul. 5, 2017 (Jul. 5, 2017) from https://printwearmag.com/features/small-or-widesublimation.
Armando Garcia Jr, "Sublimation or Screen Print designing in Action", Mar. 31, 2012 (Mar. 31, 2012) Video Retrieved on Jun. 29, 2017 (Jun. 29, 2017) from https://www.youtube.com/watch?v=Cnzg8Us-wuU.
Allana, "Difference between leggings and jeggings" Oct. 17, 2014 (Oct. 17, 2014) Retrieved on Jul. 5, 2017 (Jul. 5, 2017) from http://www.differencebetween.net/miscellaneous/fashionbeauty/difference-between-leggings-and-jeggings/.

* cited by examiner

PERFORMANCE GARMENT HAVING A REALISTIC VISUAL EFFECT OF ABRADED DENIM

BACKGROUND

The present disclosure is directed toward performance garments having the visual effect of denim and methods for preparing performance garments having the visual effect of denim. More particularly, the present disclosure is directed toward garments, such as pants, that are made of stretch performance fabric but have the appearance of being made of denim fabric.

The unique appearance of denim garments, such as jeans, is largely attributable to the denim weave and to the abrasion of the denim fabric. Denim is a cotton fabric having a twill weave in which each warp yarn passes over a number of weft yarns, typically between two and four. Typically, only the warp yarn is dyed, such as with indigo, while the weft yarn remains white. The indigo dyeing of the warp yarns is also conventionally controlled so that the core of the warp yarns remains white. Accordingly, as a denim garment is worn, it undergoes a natural abrasion or fading. This abrasion is most notable on those regions of the garment that receive the most stress. On a pair of jeans, for example, abrasion is often most apparent on the upper thighs and the seat. Natural abrasion also often includes a pattern of faded lines behind the knees (sometimes referred to as honeycombs) and/or faded streaks that surround the crotch or upper thigh areas (sometimes referred to as whiskers). Though often more subtle, worn denim is also characterized by abrasion, or fading, on the garment seams and in the area immediately adjacent to the garment seams, which is caused by the bulkiness of the seams and the stress put on the fabric in and around the seams. Although some of these abrasion patterns may be specific to denim jean pants, characteristic denim abrasion of this general sort occurs on any garment that is constructed of denim fabric.

Because this worn appearance is often a desirable component of denim garments, a denim garment is often abraded by the manufacturer prior to sale. This may be achieved in a number of ways, such as by sanding, spraying the garment with bleaching or oxidizing chemicals that lighten the indigo color in certain wear areas, water washing with pumice stone or other abrasives, laser etching, or the like. Although these abrasion methods are stressful on the fabric, the denim fabric is strong enough to withstand these processes.

In addition to the abrasion patterns described above, jeans are also characterized by a number of other features, such as features that are related to the construction of the jeans as opposed to the denim fabric itself. These characteristic features include, for example, characteristic stitching, a fly, a yoke, rivets, pockets (a traditional 5-pocket jean including a pair of curved front pockets, a pair of rear patch pockets, and a coin pocket), a characteristic waistband, belt loops, and a front button.

Due to the popularity of skin-tight denim jeans, known as skinny jeans, imitation jean products such as jeggings have been introduced to the market. Jeggings are typically made out of a blend of cotton and polyester, with a very small amount of spandex. For example, a jegging may be about 69% cotton, 30% polyester, and 1% spandex or about 70% cotton, 16% rayon, 12% polyester, and 2% spandex. Some versions of jeggings contain little to no cotton at all. For example, some jeggings may be made out of a knit fabric made up of about 95% polyester and 5% spandex. Where the cotton content is low, jeggings are typically knitted rather than woven. Other imitation jean products include Digital Luxe Denim, which is a soft sateen fabric that may be made up of, for example, about 80% cotton, about 15% rayon, and about 5% polyurethane, and that has been popularized by a company known as AG Jeans®.

Many of these imitation jean products do not use a fabric containing the traditional denim weave and thus do not naturally have the characteristic abrasion of jeans. Additionally, the fabrics used in these imitation jeans are often not strong enough to withstand the abrasion process that is applied to jeans. Therefore, to create the artificial visual appearance of a denim jean, jeggings and the like are printed with a pattern that is meant to provide the garment with the visual appearance of a denim jean. The printing is achieved by a process that includes (a) imaging the panels of an actual denim jean garment in order to capture the characteristic features of the jean, (b) converting those images to a pattern for printing onto the fabric panels that make up the imitation jean garment, and (c) printing those patterns onto the fabric panels for the imitation jean garment. The quality of the resulting visual effect varies significantly depending on the resolution that is used in the imaging process, though many imitation jeans contain printed abrasion patterns having a visual effect that is significantly less than realistic.

Notably, because all of the imitation jean products seek to have the visual appearance of actual jeans, all of the products either (i) contain the additional characteristic features of a jean, such as characteristic stitching, a fly, a yoke, rivets, pockets, a waistband, belt loops, and a front button, (ii) are printed with a pattern that is meant to mimic the additional characteristic features of a jean, or (iii) include some combination of the above, e.g. the product contains actual pockets but printed rivets. The printing of these features often also contribute to the significantly less than realistic visual effect of the imitation jean garment.

In recent years, athletic or performance garments, which are made of high-stretch performance fabrics as opposed to cotton, have become increasingly popular. Because performance garments are fragile fabrics, however, they cannot be subjected to the techniques that are used to create abrasion on denim fabrics. Additionally, not all performance fabrics are capable of being printed according to the conventional printing processes, such as sublimation printing. The present inventors have developed a new method for printing photorealistic denim weave and denim abrasion patterns onto a performance garment. Using this new method, the present inventors have prepared performance garments that combine the desirable qualities of high performance athletic wear with a realistic visual appearance of denim.

SUMMARY

Embodiments of the present disclosure are directed to a performance garment having a realistic visual effect of being constructed from abraded denim. The performance garment comprises a number of fabric panels that are adjoined together to form the garment. Each fabric panel is made of a stretch performance fabric that contains at least 50% polyester and at least 10% of one or more elastomeric materials. Each fabric panel is printed with a pattern that provides the fabric panel with the visual effect of abraded denim. For instance, each fabric panel is printed with a pattern that has the appearance of being a denim twill weave and having abrasion that is characteristic of denim fabric.

Embodiments of the present disclosure are also directed to a performance garment that has the visual effect of an abraded denim garment, including the characteristic denim seam abrasion. As described above, denim garments are characterized by abrasion, or fading, of the fabric in the area immediately adjacent to the garment seams. Embodiments of the present performance garments utilize friction-free seams that provide for an enhanced level of comfort due to the prevention of chafing or other irritation due to rubbing of the seam against the skin of a wearer. The fabric panels that are adjoined to form the garment may be specially configured so that one or more of these friction-free seams have the appearance of characteristic denim seam abrasion, i.e. provide the visual effect of an abraded denim seam. In some embodiments, all of the friction-free seams may have the characteristic denim seam abrasion.

Embodiments of the present disclosure are also directed to a performance pant that has the visual effect of an abraded denim fabric, but that does not include many of the additional features that are characteristic of a denim jean pant. As described above, in addition to the characteristic denim twill weave and abrasion, a denim jean pant is characterized by features such as characteristic stitching, a fly, a yoke, rivets, pockets (e.g. a pair of curved front pockets, a pair of rear patch pockets, and a coin pocket), a characteristic waistband, belt loops, and a front button. Embodiments of the performance pant may lack at least one of these features. For examples, some embodiments of the performance pant may not include the characteristic stitching, rivets, pockets, belt loops, fly, or front button that are characteristic of a jean pant. Some embodiments of the performance pant may not include any of these additional characteristic features of a denim jean pant.

Embodiments of the present disclosure are also directed to a performance pant that has the visual effect of an abraded denim fabric, in which the abrasion pattern of the pant is specially configured to enhance an anatomical feature of the wearer. In some embodiments of a performance pant, for example, the abrasion pattern that is applied to the seat of the performance pant may be configured to visually enhance the buttocks of the wearer, such as by making the buttocks appear more (or less) curved and/or lifted. Similarly, embodiments of a performance pant may contain an abrasion pattern on the front of the legs that is configured to visually enhance the legs of a wearer, such as by making the legs look longer and/or thinner.

Embodiments of the present disclosure are also directed to a method of preparing the performance garments described herein. A plurality of fabric panels, each fabric panel being made of a stretch performance fabric that contains at least 50% polyester and at least 10% of one or more elastomeric materials are provided. Each of the fabric panels is printed with a pattern that provides the fabric panel with the visual effect of abraded denim. Each pattern is specially configured to provide each specific fabric panel with a desired and realistic appearance when assembled into the garment.

In some embodiments, rather than being obtained by scanning a denim garment such as is done when making conventional imitation jean garments, each pattern is independently designed to provide a specially configured visual effect. As such, this process allows for the preparation of performance garments having a number of novel visual effects described herein, such as garments having characteristic denim seam abrasion, garments that are free from additional characteristic jean pant features that may detract from the realistic denim fabric effect, and garments that contain abrasion patterns that are specially designed to enhance one or more anatomical features of a wearer.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION

Figure 1:
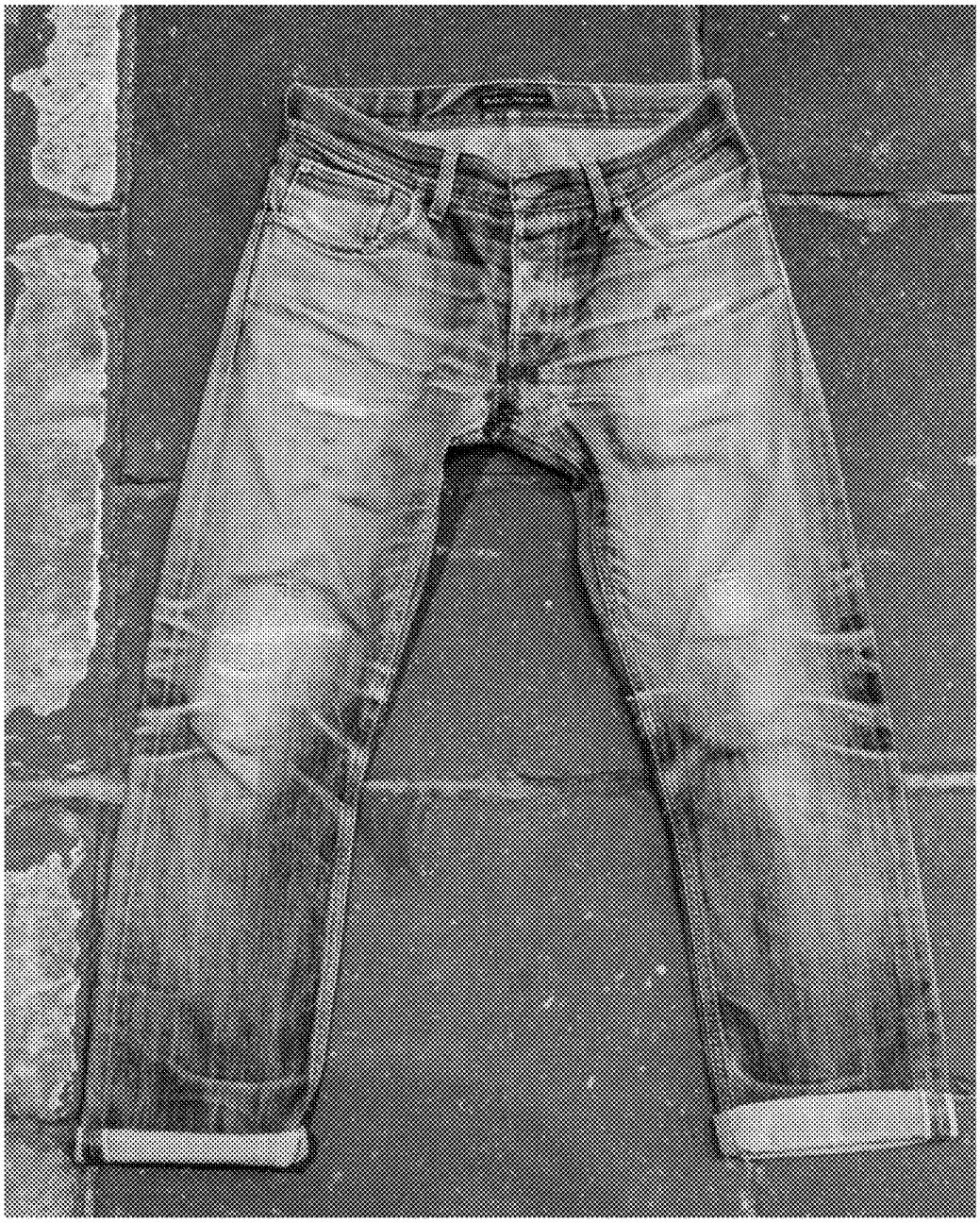
Figure 1 (Prior Art)
FIG. 1 is a front view photograph of a prior art denim pant, i.e. a pair of jeans, showing various types of characteristic denim abrasion.

Reference will now be made in detail to certain embodiment(s), examples of which are illustrated in the accompanying drawings. Whenever possible, the same reference numerals will be used throughout the drawings to refer to the same or like parts.

A conventional denim jean pant is shown in FIG. 1. Conventional denim jean pants, typically referred to as jeans, are characterized by a number of features. Some of the features are related to the denim fabric itself. For example, the denim twill weave provides a characteristic visual appearance of a fabric having a diagonal grain. Moreover, the abrasion of the denim fabric, whether naturally occurring or artificially created, leads to the identifiable and characteristic effect in which some percentage of white threads are visible within the dyed denim weave. The abrasion of the denim in this manner gives rise to a visual fading of the fabric in regions of stress (including the front of the thighs, the seat of the pants, and at the seams), whiskering effects, and honeycombing effects, among others. A number of the features and types of abrasion that are characteristic of denim jeans, and particularly worn denim jeans, are shown in FIG. 1.

As used herein, fabric having the visual effect of abraded denim should be understood as referring to a non-denim fabric that is printed with a pattern which provides the visual effect of a denim twill weave having abrasion that is characteristic of denim fabric. A garment having a realistic visual effect of being a denim garment is one that provides an observer with the visual impression of being constructed of denim fabric, even when viewed from close range, e.g. within about one foot.

Other characteristic features of conventional denim jean pants are related to the construction of the pant and not specifically to the denim fabric. For example, jeans include characteristic stitching, identifiable by the double-needle topstitch and/or the use of gold or red-orange thread. Jeans are also characterized by a number of additional functional but also visually recognizable construction elements, such as a the fly, the yoke, the characteristic waistband design, a series of belt loops, and a fastening mechanism that includes a front button and a corresponding button hole. Moreover, jeans are characterized by a specific arrangement of pockets, with a traditional 5-pocket jean including a pair of curved front pockets, a pair of rear patch pockets, and a coin pocket, although the coin pocket may be excluded in some modern jean designs. Finally, jeans are characterized by the presence of rivets, which are located at each end of the curved front pockets, as well as at the ends of the coin pocket.

Performance garments are garments that are configured so that a wearer may comfortably perform a range of exercises in the garment. Performance garments are also sometimes referred to as sportswear, activewear, or athletic wear. More recently, due to the popularity of wearing performance garments as casual wear in addition to during exercise, some performance garments have also begun to be referred to as athleisure garments. In order to render them particularly suitable for a range of exercise, performances garments are made out of a blend of one or more synthetic fibers, such as polyester, nylon, rayon, modal, or the like and one or more stretchable or elastic materials, such as spandex (also known as lycra or elastane) or the like. Notably, performance garments contain a higher proportion of stretchable or elastic materials than imitation jean products such as jeggings. The fabric in performance garments may be a 2-way or 4-way stretch woven construction, a 2-way or 4-way stretch interlock construction, a jersey knit construction, a double knit construction, or the like. Many performance garments also contain one or more of the following features, which further differentiate them from standard casual wear garments: moisture-wicking properties, low-profile seaming and construction, friction-free seams, compression waistbands, reflectivity, anti-microbial properties, and the like.

Because of the substantial differences between the relatively fragile materials used in performance garments and the strong denim fabric of conventional jeans, providing performance garments with a realistic visual effect of being a worn denim garment, i.e. being made of denim fabric and of having the visual effect of worn denim, e.g. showing indigo color loss and/or destruction at key abrasion and stress sites, has been challenging.

The inventors have discovered, for instance, that not all performance fabrics are suitable for printing with a realistic abraded denim pattern. Rather, the inventors have discovered that in order to print a photorealistic abraded denim pattern onto a performance garment, it is necessary that the garment contain at least 50% polyester and at least 10% of one or more elastomeric materials, such as spandex. The polyester content allows for the garment to be printed with a sufficiently detailed pattern using known technology, such as sublimation printing or direct digital printing. The elastomeric content, on the other hand, is necessary in order to provide the garment with the functionality that is expected of a high-quality performance garment.

Figure 3A:
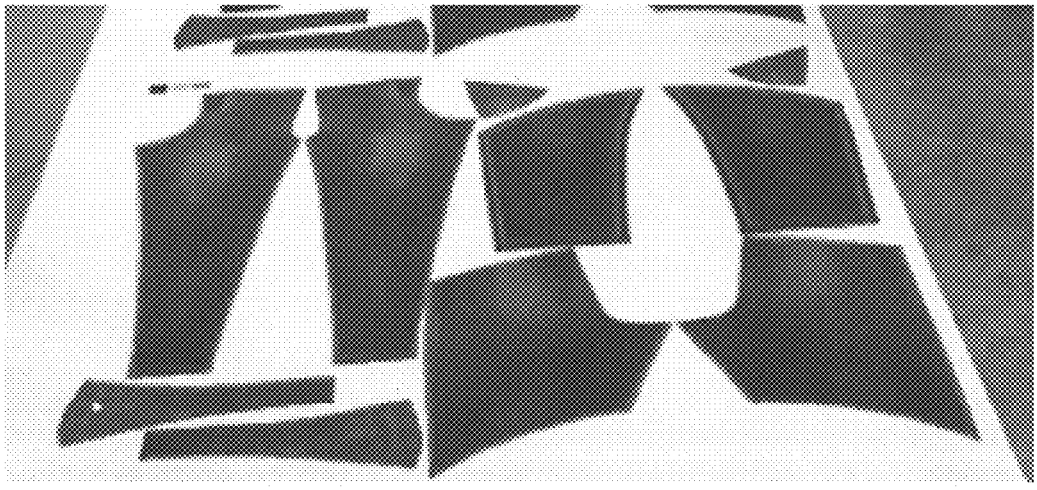
FIG. 3A is a photograph of panels that may be assembled into an embodiment of a performance garment having a realistic visual effect of being constructed from abraded denim.
Figure 3B:
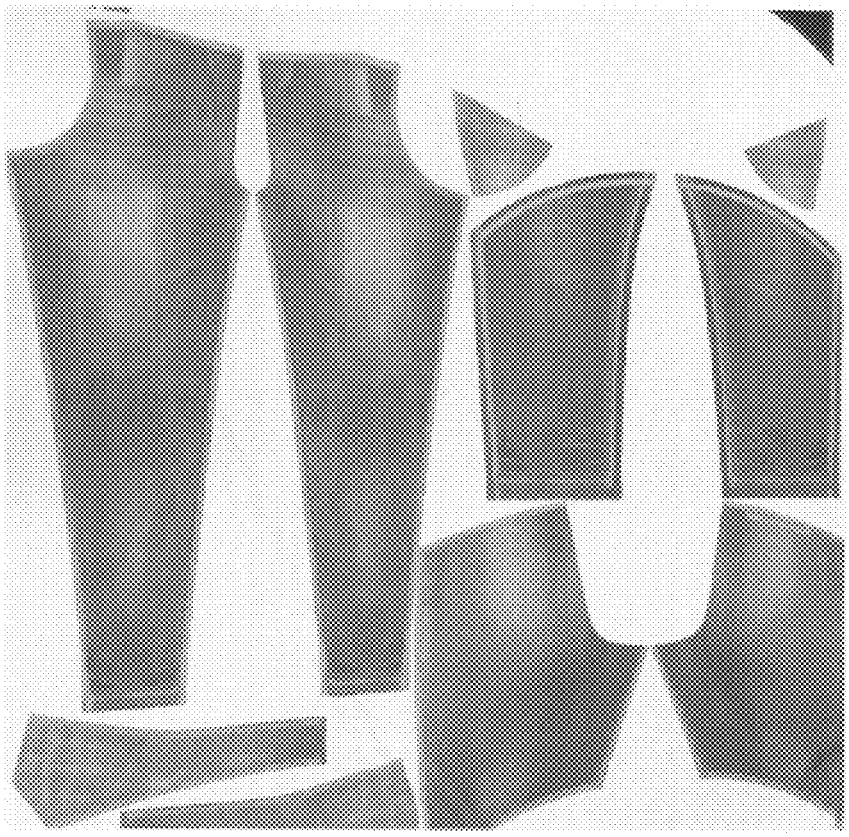
FIG. 3B is a photograph of panels that may be assembled into an embodiment of a performance garment having a realistic visual effect of being constructed from abraded denim.

The present inventors have also developed a new method for printing realistic denim weave and denim abrasion patterns onto a performance garment. In order to provide a garment having a realistic visual effect of abraded denim, the inventors have found that each of the fabric panels that make up the visible surfaces of garment must be individually printed with a pattern having the visual effect of abraded denim prior to assembly of the fabric panels into a garment. Examples of fabric sheets containing sets of fabric panels that are printed in accordance with the presently disclosed process are shown, for example, in FIGS. 3A-3B.

It is an important aspect of this process that each fabric panel is printed with a uniquely abraded denim pattern. For example, the fabric panel that makes up a front leg portion requires a different abrasion pattern than the fabric panel that makes up a rear leg portion. Accordingly, it is difficult or impossible to prepare a garment having a realistic visual effect of abraded denim using a so-called "allover" print, in which a pattern is repeated across sheet of fabric from which the fabric panels are cut. Moreover, while engineered printing, in which a series of specific patterns are printed onto specific fabric panels, is generally known in the art, the manner in which the fabric panels are printed in the presently disclosed process differs substantially from that employed by the prior art.

Specifically, in the presently disclosed process, each pattern is made up of original artwork. Each piece of original artwork is specially designed for a specific fabric panel of the performance garment. Importantly, none of the patterns are obtained by imaging or scanning a denim garment or a fabric panel from a denim garment. This distinction provides performance garments produced by this process with a number of benefits over prior known attempts to print abraded denim patterns onto non-denim fabrics. These benefits include, for example, the ability to achieve a more realistic abraded denim effect on performance fabrics, the ability to prepare performance garments having the characteristics associated with denim fabric but without the other characteristic features of jeans, and the ability to prepare performance garments having realistic seam abrasion patterns, including where the garment has seams that differ from those of jeans.

As previously described, conventional methods of printing denim patterns onto non-denim fabrics involve the imaging, such as by scanning, of either a denim garment or fabric panels from a denim garment. For instance, an actual denim garment might be broken up into its individual fabric panels, each of the individual fabric panels might be scanned, and optionally modified, in order to create a digital pattern, and the digital patterns might be printed onto panels of non-denim fabric, which are then assembled into an imitation jean garment. The abraded denim pattern produced by this process, however, is often of low resolution, which leads to an imitation jeans garment having an artificial, i.e. fake, visual denim effect. By digitally creating the artwork, the presently disclosed process provides for a higher pattern resolution, for example a resolution of at least 300 dpi (dots per inch), preferably at least 350 dpi, more preferably at least 400 dpi, and thus a more realistic visual effect of abraded denim. This enhanced resolution is particularly important for printing on performance fabrics, which undergo more significant stretching than the fabrics used in conventional imitation jeans. Accordingly, embodiments of the present disclosure are directed to performance garments having a realistic visual effect of abraded denim of the sort that is not obtainable using prior known processes.

In addition to providing a pattern that is capable of providing a performance garment with a realistic visual effect of being a denim garment, the presently disclosed process provides for the preparation of performance garments having the characteristics associated with denim fabric but that lack the other characteristic features of jeans. Using conventional methods of printing denim patterns onto non-denim fabrics, non-fabric related characteristic features of the jeans are also either made a part of the imitation jeans or incorporated into the pattern and printed onto the non-denim fabric that makes up the imitation jeans. For instance, imitation jeans products often contain printed rivets, belt loops, seams (such as the yoke seam), waistbands, buttons, flies, and the like. The printing of these additional features onto the garment are often a major contributor to the artificial visual appearance that is associated with imitation jean garments.

The presently disclosed method, in contrast, is not designed to produce an imitation jean garment. Rather, the presently disclosed method provides one with the ability to create unique garments that have the visual appearance of abraded denim while avoiding the negative aspects associated with conventional imitation jeans, such as additional visibly artificial features. The ability to achieve a realistic visual effect of abraded denim while avoiding the need for either incorporating or printing construction-related jeans features is particularly important for performance garments, which typically do not contain the same design and construction elements of jeans. Accordingly, embodiments of the present disclosure are directed to performance garments having a realistic visual effect of abraded denim but that do not contain the construction-related characteristic features of jeans.

Similarly, the presently disclosed process also provides for the creation of garments having the visual appearance of being constructed from abraded denim fabric but having unique construction elements that differ significantly from those of jeans and known imitation jeans. For example, the presently disclosed process allows for the preparation of a performance garment having an arrangement of seams that differs substantially from those in a corresponding denim garment. A performance pant, for instance, may contain a seam on the rear of the leg as opposed to a standard outer side seam. Using the presently disclosed process, the seam on the rear of the leg may be configured to contain a realistic denim abrasion pattern, even though that seam would not exist on conventional jeans. This would not be feasible using the conventional methods described above. Accordingly, embodiments of the present disclosure are directed to performance garments having a realistic visual effect of abraded denim but having seam arrangements that differ from conventional denim garments such as jeans.

Further, the presently disclosed process allows for the creation of realistic denim seam abrasion on a garment that does not contain a standard denim seam. In order to obtain a garment that has a realistic visual effect of denim seam abrasion, the pattern that is printed on each fabric panel must be extremely precise. This is because the printed abrasion must match up exactly with the location of the seam in the garment, which is difficult to consistently reproduce given the variety of sizes for which a commercial garment must typically be constructed. Conventional engineered prints utilize one or two anchor points that determine the positioning of the print, which is insufficient to provide realistic denim seam abrasion. Moreover, where the abrasion pattern is taken from an image of a denim garment, it is highly unlikely that the seam abrasion pattern will coincide with the actual seam of the non-denim garment in order to provide a realistic visual effect. Because a realistic effect of denim seam abrasion of the sort described herein may not be obtained with any sort of consistency using conventional methods, conventional imitation jeans generally do not contain denim seam abrasion effects.

The problems associated with obtaining a printed garment having a realistic visual effect of denim seam abrasion may only be increased when the garment is a performance garment. For instance, performance garments often contain different styles of seams, such as friction-free seams, which differ significantly from the types of seams used in conventional denim garments. Using the presently disclosed process, however, the inventors are able to create a garment having a realistic visual effect of denim seam abrasion at the garment seams, even where those garment seams are friction-free seams and even where the garment seams are in different locations from those on a conventional denim garment such as jeans. For example, in various embodiments, each size of a garment may be prepared from panels that are printed with their own unique artwork, i.e. artwork that is different from every other size of the garment. Moreover at least three of the garment seams may be utilized as anchor points in order to provide a realistic visual effect of denim seam abrasion. Alternatively at least four of the garment seams may be utilized as anchor points, alternatively at least five of the garment seams, alternatively at least six of the garment seams. In some embodiments, a majority of the garment seams may be utilized as anchor points.

One or more of the panels that are affixed together to prepare a garment may be provided with precision artwork that anchors to each of the seam points formed by the panel when the garment is prepared. For instance, in some embodiments, a majority of the panels may be provided with precision artwork that anchors to each of the seam points formed by the panel when the garment is prepared. Alternatively every one of the panels may be provided with precision artwork that anchors to each of the seam points formed by the panel when the garment is prepared. In order to provide a realistic visual effect of denim seam abrasion, the artwork at the seam edges of the panels may be within a level of precision having a maximum of ¼ inch tolerance, more preferably a maximum of ⅛ inch tolerance.

Figure 2A:
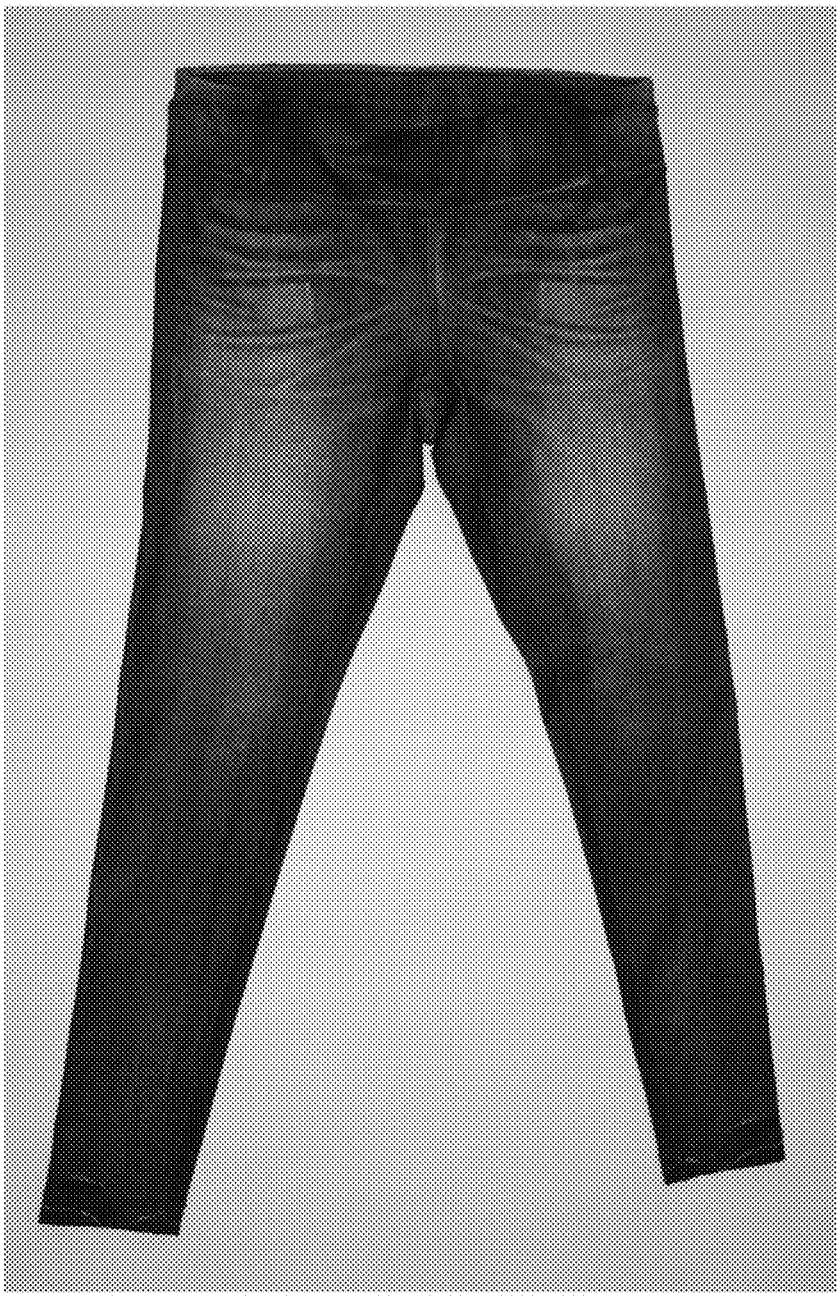
FIG. 2A is a front view photograph of an embodiment of a performance garment having a realistic visual effect of being constructed from abraded denim.
Figure 2B:
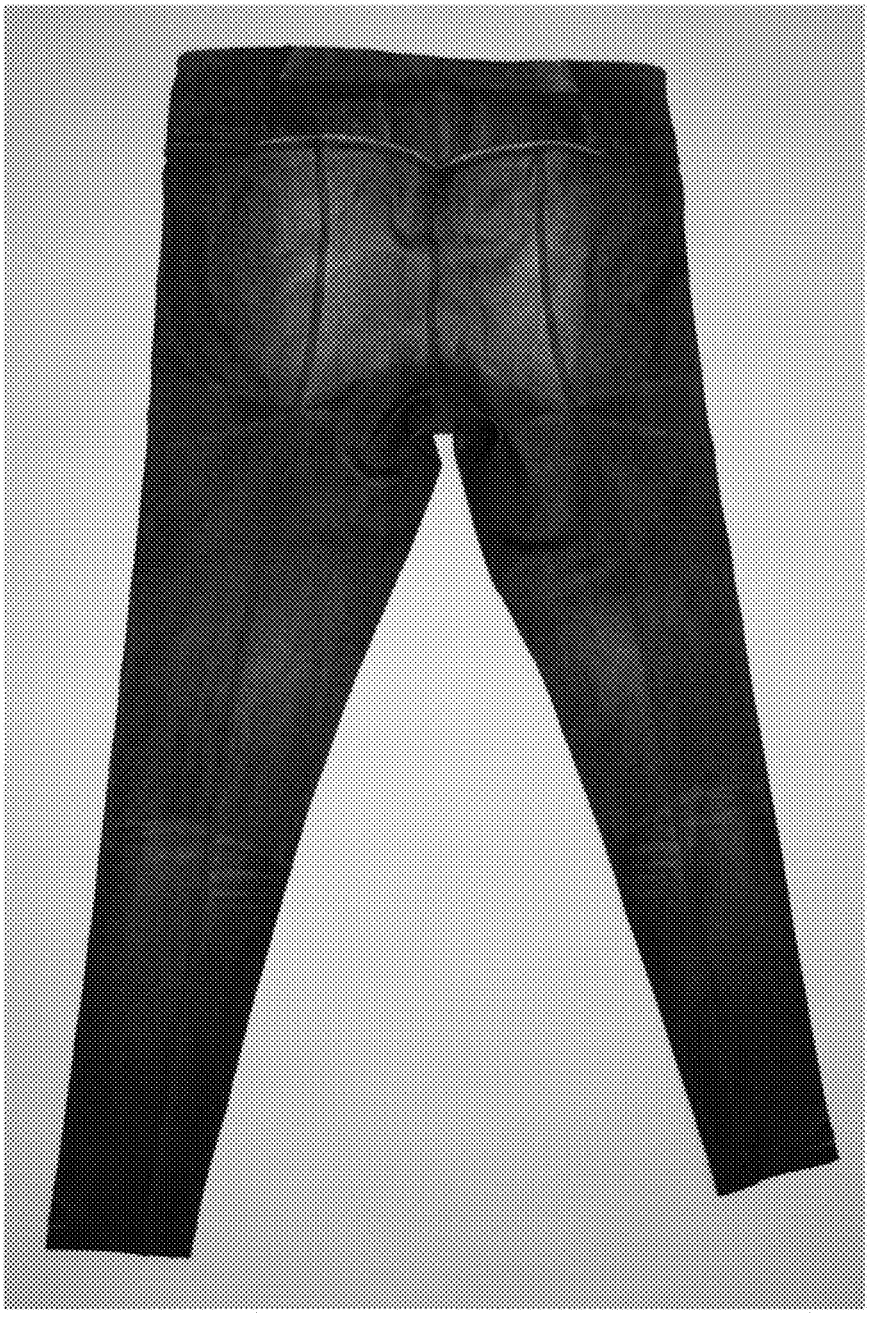
FIG. 2B is a rear view photograph of an embodiment of a performance garment having a realistic visual effect of being constructed from abraded denim.

Embodiments of the present disclosure are directed to a performance garment 10 having a realistic visual effect of being a denim garment. An exemplary garment is shown in FIGS. 2A and 2B. The performance garments are constructed from a number of fabric panels, the fabric panels being adjoined together by a number of seams. The fabric panels are made of a stretch performance fabric that contains at least 50% polyester and at least 10% of one or more elastomeric materials. In some embodiments, the performance garment may comprise, for example, at least 11% elastomeric material, alternatively at least 12% elastomeric material, alternatively at least 13% elastomeric material, alternatively at least 14% elastomeric material, alternatively at least 15% elastomeric material. The fabric panels may be constructed using a 2-way or 4-way stretch woven construction, a 2-way or 4-way stretch interlock construction, a jersey knit construction, a double knit construction, or the like. For example, various embodiments of the present disclosure may include a knit jersey garment comprising about 86 to 88% polyester and about 12 to 14% spandex or a woven garment comprising about 86 to 88% polyester and about 12 to 14% spandex.

Each fabric panel is printed with a pattern that provides the panel with the visual effect of an abraded denim fabric. It should be understood that each and every fabric panel that is incorporated into a garment need not be printed with an abraded denim pattern; rather each fabric panel that is visible on the exterior of the garment once the garment is assembled should be provided with the visual effect of an abraded denim fabric. Panels that are only visible on the interior of the garment or that are not visible at all (e.g. the interior of a pocket) need not be printed with any particular pattern.

As described above, each fabric panel is printed with a specific denim abrasion pattern that is consistent with the sort of abrasion that might naturally occur in denim at its corresponding position within the garment. Moreover, each fabric panel may be printed with a pattern that is specially designed for the fabric panel. For instance, each fabric panel may be printed with an original digitally designed pattern, and not a pattern that was prepared from an image of an actual denim garment. Accordingly, each fabric panel may be printed so as to have a high-resolution, and therefore realistic, visual effect of abraded denim. When the fabric panels are properly assembled to form a garment, therefore, the garment will have the realistic visual effect of being an abraded denim garment.

In some embodiments, the performance garment may comprise one or more friction-free seams where the fabric panels are adjoined together. Friction-free seams are seams which are designed so that the interior of the garment does not irritate the skin of the wearer, such as through rubbing, chafing, and the like. Accordingly, a friction-free seam is configured so that the interior surface is smooth. The friction-free seam may also be a low profile seam, such as may be desirable in performance garments, which generally have a tight fit. Friction-free seams of the sort that may be used in embodiments of the performance garments disclosed herein include flatlock seams, welded seams, and the like. Flatlock stitching is a preferred seam for high stretch performance garments because of its low profile and durability in areas of extreme tension. Welded seams, also known as bonded seams, are used to hold seams together without the use of thread stitching. As such, welded seams have an extremely low profile. Welded seams are not as strong as flatlock seams, however, and thus may not be appropriate in areas of extreme tension. In some embodiments, every seam of the performance garment may be a friction-free seam. In other embodiments, the performance garments may also include overlock seams or the like.

Figure 4:
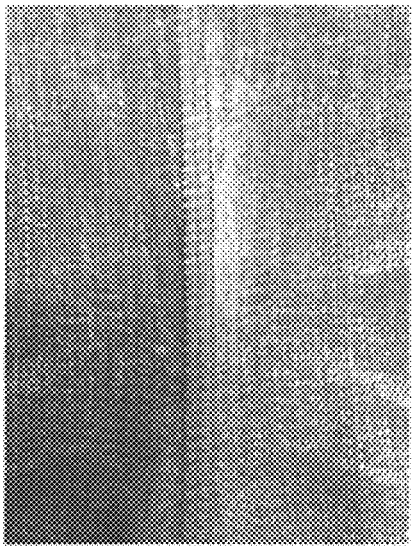
FIG. 4 is a photograph showing an embodiment of a seam of a performance garment having realistic denim seam abrasion.

In some embodiments, one or more seams of the performance garment may be provided with the visual effect of denim seam abrasion. For instance, the performance garments of certain embodiments may have one or more friction-free seams that provide the visual effect of denim seam abrasion. In some embodiments, every seam of the performance garment that is visible on the exterior of the garment may be provided with the visual effect of denim seam abrasion. As illustrated in FIG. 4, denim seam abrasion comprises a portion of the fabric immediately adjacent to the seam having a visible faded effect. Although subtle, the inventors have found that garments having the visual effect of denim seam abrasion more effectively provide the impression of being constructed from denim fabric and thus provide a more realistic effect of being a denim garment.

In some embodiments, the performance garments may have seams that are not located in the same locations as conventional pant seams. For instance, in the embodiment illustrated in FIG. 2, a standard outer side seam is replaced by a seam that is located on the rear of the leg. By moving the outer side seam to the rear of the leg, the seam has been relocated from an area of high-chafing during exercises that involve running (the outside of the leg) to an area of low-chafing during exercises that involve running (the rear of the leg). As with the other seams of the garment, these uniquely positioned seams may be friction-free seams. Additionally, as with the other seams of the garment, these uniquely positioned seams may be provided with the visual effect of denim seam abrasion.

In some embodiments, the performance garments may lack characteristic features, either actual or printed, of conventional jeans that are related to the construction of the pant and not specifically to the denim fabric itself. For example, some performance garments may lack the characteristic jean stitching, the characteristic jean waistband, belt loops, a fly, a front button fastening mechanism, a yoke, characteristic jean pockets, rivets, or any combination thereof. For instance, in some embodiments, a performance garment may not include any of the above-listed characteristic jean features. Rather, embodiments of the performance garments disclosed herein represent unique and novel garments that have the visual effect of being made from abraded denim fabric, without having the visual effect of being either actual or artificial jeans.

In some embodiments, the performance garments may have an abrasion pattern that is specially configured to enhance one or more anatomical features of the wearer. For example, the abrasion patterns formed on the performance garment may not entirely match up with an abrasion pattern that would naturally be formed in a denim garment. Rather, the abrasion pattern may be specially configured in order to make a body part of the wearer appear more attractive to an observer, such as by emulating the contours of what is statistically viewed as an ideally-proportioned body.

U.S. application Ser. No. 14/517,339, published as U.S. Pat. Pub. No. 2015/0106993 A1, which is incorporated by reference herein in its entirety, describes a process in which a garment may be provided with a pattern that emulates the contours of an ideally-proportioned body to as to give observers the impression of the ideal proportion. Specifically, for example, the '339 application describes a pair of jeans provided with an abrasion pattern on the buttock region that emulates contours of ideally proportioned buttocks by forming a brightness gradient that contains relatively bright spots associated with central regions of buttocks of the ideally proportioned buttocks, relatively dark spots associated with infragluteal folds of the ideally proportioned buttocks, and/or relatively dark spots associated with a V-shaped crease of the ideally proportioned buttocks. Observers' preferences for jeans that were "enhanced" in this way over jeans having conventional abrasion patterns were reliable and significant. In some embodiments, the performance garments disclosed herein may contain an abrasion pattern on the seat of the pants that is configured to enhance the buttocks of a wearer, such as by emulating the contours of ideally proportioned buttocks. For example, the abrasion pattern that is applied to the seat of the performance pant may be configured to visually enhance the buttocks of the wearer by making the buttocks appear either more or less curved and/or lifted.

In some embodiments, the performance garments may contain an abrasion pattern on the front of the leg that is configured to enhance the legs of a wearer, such as by making them look longer and/or thinner. For example, the abrasion pattern on the front leg of the performance garment may be designed such that the abrasion located on the front of the thigh stops above the knee. This is in contrast to naturally-occurring abrasion, which would extend onto, and sometimes past the knee. By having the abrasion positioned on the front of the thigh stop above the knee, however, one may provide the effect of having a longer leg. The abrasion pattern on the front of the leg may also be configured as a narrow strip that runs down the center of the thigh. This is in contrast to naturally-occurring abrasion, which would span across a large portion of the width of the thigh. By having the abrasion configured as a narrow strip, however, one may provide the effect of having a thinner leg. These leg-enhancing abrasion features may be used either alone or in combination with one another, e.g. by providing a relatively narrow strip down the center of the thigh and that is cut off above the knee. Additionally, a leg-enhancing abrasion pattern may be used in combination with the buttock-enhancing pattern described above.

The performance garments of embodiments described herein may also contain one or more functional features, such as quick dry or moisture-wicking properties, temperature control properties, low-profile seaming and construction, friction-free seams, drawstring or compression waistbands, reflectivity, anti-microbial properties, and the like.

For example, in some embodiments, the performance garment may be quick-dry or having quick-dry panels. In some embodiments, the quick-dry garments or panels may be moisture-wicking. Moisture-wicking garments are configured to move moisture away from the body to the surface of a fabric so that it dries more quickly. For example, in some embodiments, a quick-dry garment may comprise a four-way stretch woven fabric comprising a blend of polyester, Lyocell, and spandex. In some embodiments, one or more panels of a garment may incorporate Coolmax® moisture-wicking performance fabric. For example, the garment may comprise a running tight in which the panels that make up the gussets of the pant are Coolmax® moisture-wicking performance fabric.

In some embodiments, the performance garment may have temperature control features. For instance, the performance garment may comprise technology that helps regulate body temperature by keeping a wearer warmer in cold weather and/or cooler in warm weather. For instance, the performance garments may be configured to provide enhanced ventilation, such as by including mesh or ribbed materials at high sweat areas.

In some embodiments, the performance garment may have either a compression waistband or a drawstring waistband. Compression waistbands comprise a stretchable fabric that is designed to hold the portion of the body adjacent to the waistband in place during exercise. Compression garments and waistbands are known to provide beneficial effects when worn during exercise. In many embodiments, the compression waistband may be a high-rise or wide waistband, such as a waistband having a width of at least 2 inches, alternatively at least 3 inches, alternatively at least 4 inches, alternatively at least 5 inches. Wide waistbands provide a flattering slimming effect that flattens out the tummy rather than cutting into it.

In some embodiments, the performance garment may have a low profile construction. For example, embodiments of the performance garment may have a flat seam construction in which a flatlock machine is used to join together the fabric in a way that creates the least amount of bulk as possible. Flat seam construction also helps to prevent chaffing and discomfort in key areas close to body.

In some embodiments, the performance garment may have reflectivity properties. For example, in some embodiments, the performance garment may comprise one or more materials capable of reflecting light. For example, a performance garment, such as a running tight, may contain a heat-transfer reflective material (e.g. logo) on the wearer's lower leg that is highly visible when light is reflected upon it. The inclusion of reflective materials may be used as a safety feature that helps protect a runner from traffic in low light conditions.

Figure 5:
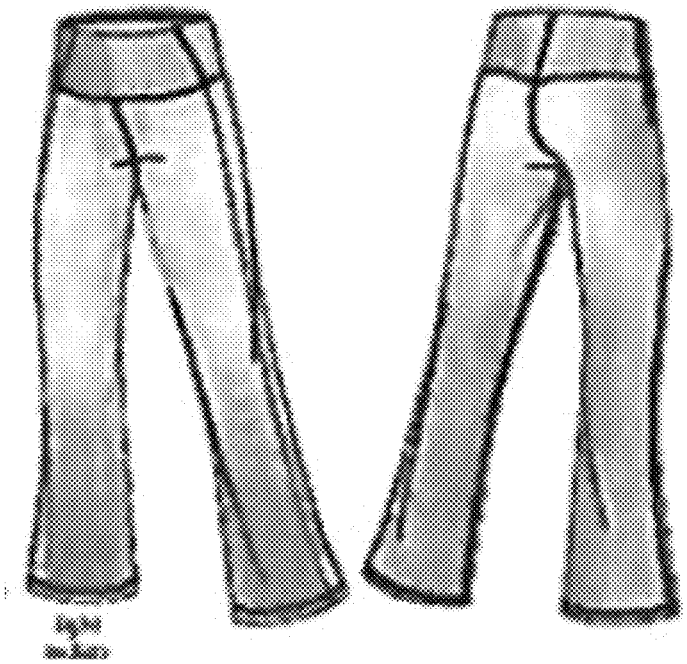
FIG. 5 is a combination of front-perspective and rear-perspective views of a yoga pant performance garment, which according to embodiments of the present disclosure has a realistic visual effect of being constructed from abraded denim.

The performance garments described herein may take on any number of product designs. In some embodiments, for example, the performance garment may be a yoga pant, which is also sometimes referred to as a flare pant. An embodiment of a yoga pant is shown in FIG. 5. A yoga pant is generally made from a polyester/spandex knit single jersey fabric. While a yoga pant is designed such that it can be used across a range of exercise, it also comprises a number of features that are particularly functional for yoga. For instance, a yoga pant contains a high-rise compression waistband. The legs of a yoga pant generally contain a tight-fitting upper portion and a looser-fitting flared bottom portion. A yoga pant also preferably contains friction-free seams, more preferably in the form of flatlock stitched seams. A yoga pant may also contain one or more pockets, such as a secure waistband pocket. A yoga pant may also have a crotch gusset, which increases comfort, e.g. by preventing chafing, and mobility during stretches and extensions. The crotch gusset may also comprise a moisture-wicking fabric.

Figure 6:
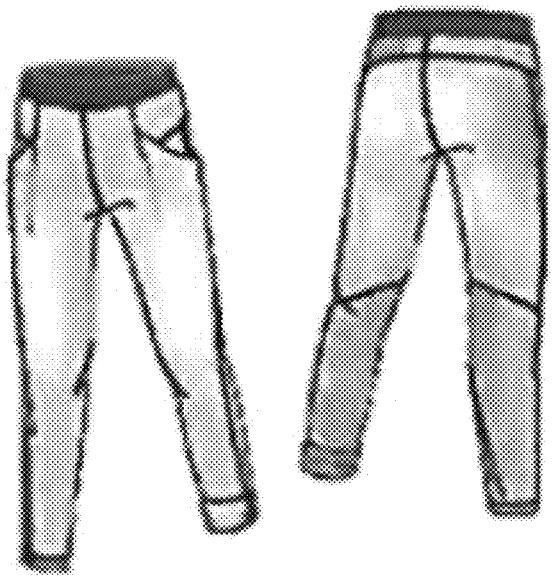
FIG. 6 is a combination of front-perspective and rear-perspective views of a training pant performance garment, which according to embodiments of the present disclosure has a realistic visual effect of being constructed from abraded denim.

In some embodiments, the performance garment may be a boyfriend pant, also known as a training pant. An embodiment of a boyfriend pant is shown in FIG. 6. A boyfriend pant is generally designed for training. A boyfriend pant is typically constructed from a lightweight, moisture-wicking fabric, such as a stretch woven fabric comprising a blend of polyester, Lyocell, and spandex (such as a blend of 83% polyester, 11% Lyocell, and 6% spandex). The legs of a boyfriend pant are generally relaxed through the hips and thighs but taper towards the ankle. A boyfriend pant features ergonomic seaming, such as an absence of a side seam at the high hip, ergonomic (e.g. easy reach) and functional hand pockets that have a wide opening and depth to actually insert your hands comfortably, and leg seams that contour when the leg is bent. A boyfriend pant may also comprise front and/or rear pockets, though it should be noted that the pockets of a boyfriend pant differ significantly from the curved front pockets and patch rear pockets that are characteristic of jeans. Moreover, a boyfriend pant also comprises a knit waistband, which is comfortable, soft, and adaptive yet supportive around the waist.

Figure 7:
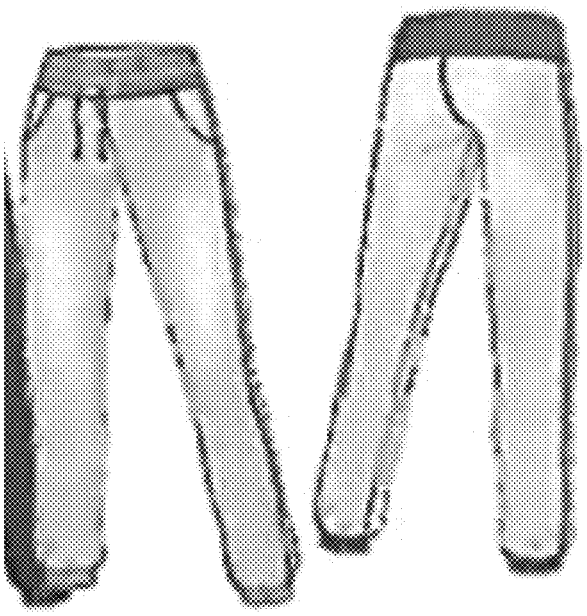
FIG. 7 is a combination of front-perspective and rear-perspective views of a jogger pant performance garment, which according to embodiments of the present disclosure has a realistic visual effect of being constructed from abraded denim.

In some embodiments, the performance garment may be a jogger pant. An embodiment of a jogger pant is shown in FIG. 7. A jogger pant is generally designed for training. A jogger pant is typically constructed from a moisture-wicking knit fabric, such as a knit interlock fabric comprising a blend of polyester and spandex. The legs of a jogger pant are generally a relaxed fit. A jogger pant typically features a drawcord waistband, which allows a wearer to tighten the waistband to a desired degree. A jogger pant also may include elasticated leg openings, which similarly allow a user to tighten or loosen the ankle region of the pant when wearing, or when donning or doffing. A jogger pant may also comprise front and/or rear pockets, though it should be noted that the pockets of a jogger pant differ significantly from the curved front pockets and patch rear pockets that are characteristic of jeans. For example, the pockets may be ergonomic (easy reach) and functional hand pockets that have a wide opening and depth to actually insert your hands comfortably. A jogger pant may also have leg seams that contour when the leg is bent.

Figure 8:
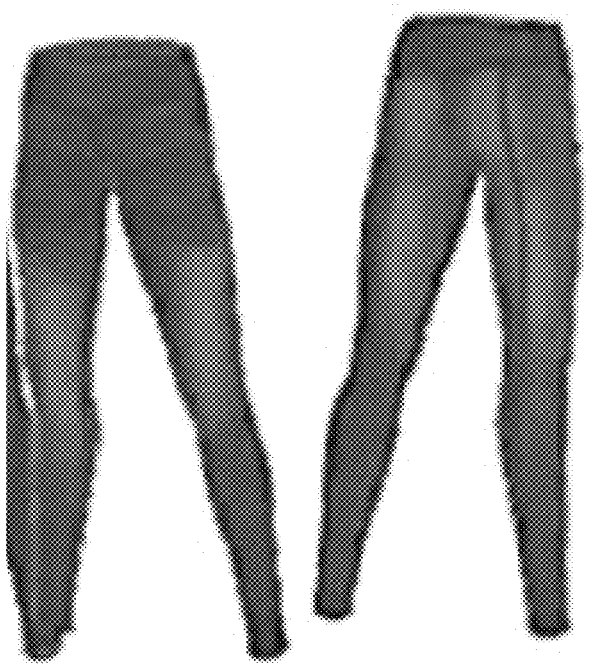
FIG. 8 is a combination of front-perspective and rear-perspective views of a running tight performance garment, which according to embodiments of the present disclosure has a realistic visual effect of being constructed from abraded denim.

In some embodiments, the performance garment may be a running pant, such as a running tight. An embodiment of a running tight is shown in FIG. 8 (as well as in FIGS. 2A-2B). A running tight is generally made from a fast-drying material such as polyester/spandex knit interlock fabric. The fabric of a running tight may also be provided with a slick face to minimize fabric friction during running and other aerobic exercise. While a running tight is designed such that it can be used across a range of exercise, it also comprises a number of features that are particularly functional for running (or yoga). For example, a running tight typically comprises a compression waistband that is also outfitted with a drawcord, such as an internal drawcord, which allows a wearer to tighten the waistband to a desired degree during high cardio and mobility activity. The legs of a running tight generally are designed for a tight-fit. A running tight may be designed to either cover the full length of a wearer's leg or to end somewhere between the knee and the ankle. A running tight also preferably contains friction-free seams, more preferably in the form of flatlock stitched seams. A running tight may also contain one or more pockets, such as a secure waistband pocket. In some embodiments, such as that shown in the Figures, a running tight may also comprise a modified seam, such as where the traditional side-seam is relocated to the rear of the leg, which reduces chafing. Embodiments of a running tight may also comprise one or more panels, such as leg gussets, comprising moisture-wicking materials. In some embodiments, a reflective branding device located on the back of one or more legs offers additional visibility for the wearer in low-light outdoor conditions.

It can be seen that the described embodiments provide unique and novel methods and garments that have a number of advantages over those in the art. While there is shown and described herein certain specific structures embodying the disclosed methods and garments, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A performance garment comprising:

a plurality of fabric panels adjoined together to form a garment, the plurality of fabric panels comprising a stretch performance fabric containing at least 50% polyester and at least 10% of one or more elastomeric materials, and the plurality of fabric panels being printed with patterns that provide the plurality of fabric panels with the visual effect of an abraded denim fabric, such that the garment provides a realistic visual effect of being an abraded denim garment; and the garment further comprising one or more friction-free seams where the plurality of fabric panels are adjoined together.

2. The performance garment of claim 1, wherein one or more of the friction-free seams provides the visual effect of an abraded denim seam.

3. The performance garment of claim 2, wherein one or more of the friction-free seams are flatlock seams that provide the visual effect of an abraded denim seam.

4. The performance garment of claim 2, wherein at least one of the friction-free seams that provide the visual effect of an abraded denim seam is located at a position on the garment that does not correspond with a seam from a conventional denim jean.

5. The performance garment of claim 1, wherein the garment does not include any of the following features of a conventional denim jean: characteristic jean stitching, rivets, characteristic jean pockets, belt loops, a fly, or a front button.

6. The performance garment of claim 1, wherein the plurality of fabric panels provide the visual effect of abrasion that would naturally occur at the corresponding location in a denim garment.

7. The performance garment of claim 1, wherein the garment is a running tight, a yoga pant, a training pant, or a jogger pant.

8. A method of preparing a performance garment comprising:

a plurality of fabric panels adjoined together to form a garment, the plurality of fabric panels comprising a stretch performance fabric containing at least 50% polyester and at least 10% of one or more elastomeric materials, and the plurality of fabric panels being printed with patterns that provide the plurality of fabric panels with the visual effect of an abraded denim fabric, such that the garment provides a realistic visual effect of being an abraded denim garment, the method comprising:

providing a plurality of fabric panels, the plurality of fabric panels comprising a stretch performance fabric containing at least 50% polyester and at least 10% of one or more elastomeric materials;

printing the plurality of fabric panels with patterns that provide the plurality of fabric panels with the visual effect of abraded denim, wherein each pattern is designed for a specific fabric panel; and assembling the plurality of fabric panels to form a performance garment having the realistic visual effect of being an abraded denim garment.

9. The method of claim 8, further comprising preparing the patterns for the plurality of fabric panels to correspond to a garment having a particular size.

10. The method of claim 8, further comprising preparing the patterns for the plurality of fabric panels without imaging the panels of an actual denim garment and converting the resulting images to a pattern.

11. The method of claim 10, further comprising adjoining one or more of the plurality of fabric panels using a friction-free seam in a manner that provides the visual effect of an abraded denim seam.

12. The method of claim 11, wherein using a friction-free seam includes using a flatlock seam, a bonded seam, a friction-free cover stitch seam, an overlock seam, or an ActiveSeam™.

13. The method of claim 11, further comprising positioning the friction-free seam at a position on the garment that does not correspond with a seam from a conventional denim jean.

14. The method of claim 8, wherein the printing comprises sublimation printing or direct digital printing.

15. The method of claim 8, wherein the patterns provide the plurality of fabric panels with the visual effect of abrasion that would naturally occur at the corresponding location in a denim garment.

16. A performance garment comprising:

a plurality of fabric panels adjoined together to form a garment, the plurality of fabric panels comprising a stretch performance fabric containing at least 50% polyester and at least 10% of one or more elastomeric materials, and the plurality of fabric panels being printed with patterns that provide the plurality of fabric panels with the visual effect of an abraded denim fabric, such that the garment provides a realistic visual effect of being an abraded denim garment;

wherein the garment does not include any of the following features of a conventional denim jean: characteristic jean stitching, rivets, characteristic jean pockets, belt loops, a fly, or a front button.

17. The performance garment of claim 16, the garment further comprising one or more friction-free seams where the plurality of fabric panels are adjoined together, wherein one or more of the friction-free seams provides the visual effect of an abraded denim seam.

18. The performance garment of claim 17, wherein one or more of the friction-free seams are flatlock seams that provide the visual effect of an abraded denim seam.

19. The performance garment of claim 18, wherein at least one of the friction-free seams that provide the visual effect of an abraded denim seam is located at a position on the garment that does not correspond with a seam from a conventional denim jean.

20. The performance garment of claim 16, wherein the garment is a running tight, a yoga pant, a training pant, or a jogger pant.

* * * * *